US008075092B2

(12) United States Patent
Sakano

(10) Patent No.: US 8,075,092 B2
(45) Date of Patent: Dec. 13, 2011

(54) INKJET RECORDING APPARATUS

(75) Inventor: Yuji Sakano, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 524 days.

(21) Appl. No.: 12/243,675

(22) Filed: Oct. 1, 2008

(65) Prior Publication Data

US 2009/0085971 A1 Apr. 2, 2009

(30) Foreign Application Priority Data

Oct. 1, 2007 (JP) ..... 2007-257225

(51) Int. Cl.
*B41J 23/00* (2006.01)
*B41J 2/155* (2006.01)
*B41J 2/01* (2006.01)

(52) U.S. Cl. ..... 347/37; 347/42; 347/104

(58) Field of Classification Search ..... 347/37, 347/42, 101, 104
See application file for complete search history.

(56) References Cited

U.S. PATENT DOCUMENTS 6,217,143 B1 * 4/2001 Munakata et al. ..... 347/16

FOREIGN PATENT DOCUMENTS

JP 2005-014445 * 1/2005
JP 2005-014445 A 1/2005

* cited by examiner

*Primary Examiner* — Geoffrey Mruk
(74) *Attorney, Agent, or Firm* — Baker Botts L.L.P.

(57) ABSTRACT

An inkjet recording apparatus includes: a conveyance mechanism which conveys a recording medium in the conveyance direction; an inkjet head; a first movement mechanism; a first movement printing controller; a fixed printing controller; and a mode instructor which instructs which one of the first movement printing controller and the fixed printing controller is to be active. The first movement mechanism causes the inkjet head to make a first movement parallel to the conveyance direction. The first movement printing controller controls the conveyance mechanism so that the recording medium stops at a predetermined position. The first movement printing controller also controls the inkjet head and the first movement mechanism so that the inkjet head ejects ink to a stopped recording medium during the first movement. The fixed printing controller controls the conveyance mechanism so that the recording medium passes through an area where the recording medium faces the ejection surface. The fixed printing controller also controls the inkjet head so that the stopped inkjet head ejects ink to the moving recording medium.

10 Claims, 6 Drawing Sheets

MAIN SCANNING DIRECTION

SUB SCANNING DIRECTION

MAIN SCANNING DIRECTION

SUB SCANNING DIRECTION

INKJET RECORDING APPARATUS

The present application claims priority from Japanese Patent Application No. 2007-257225, which was filed on Oct. 1, 2007, the disclosure of which is herein incorporated by reference in its entirety.

BACKGROUND OF THE INVENTION

1. Field of the Invention

The present invention relates to an inkjet recording apparatus which prints an image on a recording medium.

2. Description of Related Art

Japanese Unexamined Patent Publication 2005-14445 discloses a line inkjet printer including a first conveyor having a conveyor belt which conveys a cut sheet, and a line head assembly which ejects ink to the cut sheet while moving parallel to the conveyor direction of the cut sheet. In this inkjet printer, the conveyor belt conveys a cut sheet to an image recording position. The line head assembly, while moving parallel to the conveyor direction, ejects ink to the cut sheet maintained at the position, thereby forming an image onto the cut sheet.

SUMMARY OF THE INVENTION

Although the line inkjet printer disclosed in above patent document 1 is capable of performing high quality printing since an image is formed on the cut sheet while the conveyance of the cut sheet is stopped, the line inkjet printer is not capable of performing high speed printing since a printing time for one cut sheet is elongated. A conceivable approach to achieve high speed printing is to fix the inkjet head and to print an image on the cut sheet while the sheet is conveyed by the conveyor belt. This approach however is disadvantageous in terms of the quality of the image formed on the cut sheet, for the reason that there remains some difficulty in achieving a stable conveyance of the cut sheet. Examples of the difficulty are the lifting of the cut sheet from the conveyor belt, and slippage of the conveyor belt. Thus, high speed printing is not possible with the former since the cut sheet is stopped during printing, and high quality printing is not possible with the latter since the cut sheet is moving during printing.

An object of the present invention is to provide an inkjet recording apparatus which enables both high quality printing and high speed printing.

An inkjet recording apparatus of the present invention includes: a conveyance mechanism which conveys a recording medium in a conveyance direction; an inkjet head having an ejection surface on which a plurality of ink ejection openings are formed, the ink ejection openings being arranged so that the inkjet head has a predetermined resolution in a direction perpendicular to the conveyance direction; a first movement mechanism which causes the inkjet head to make a first movement between an upstream position and a downstream position, the first movement being a movement in the conveyance direction, the upstream position and the downstream position sandwiching therebetween a predetermined position along the conveyance direction; a first movement printing controller which controls: the conveyance mechanism so that a recording medium stops at such a position that the recording medium faces the ejection surface of the inkjet head positioned at the predetermined position; and then the inkjet head and the first movement mechanism so that the inkjet head, while making the first movement, ejects ink to the stopped recording medium; a fixed printing controller which controls: the conveyance mechanism so that a recording medium passes through such an area that the recording medium faces the ejection surface; and then the inkjet head so that the inkjet head, while being stationary, ejects ink to the moving recording medium; and a mode instructor which instructs, in a switchable manner, which one of the first movement printing controller and the fixed printing controller is to be active.

According to the above structure, it is possible to select a first movement printing mode for high quality printing, or fixed printing mode for high speed printing, the first movement printing mode being a mode which performs printing by ejecting ink to a stopped recording medium while moving an inkjet head, and the fixed printing mode being a mode which performs printing by ejecting ink from an inkjet head which is stopped while conveying a recording medium. Thus, it is possible to realize an inkjet recording apparatus which enables both high quality printing and high speed printing.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes an inkjet printer according to an embodiment of the present invention.

Figure 1:
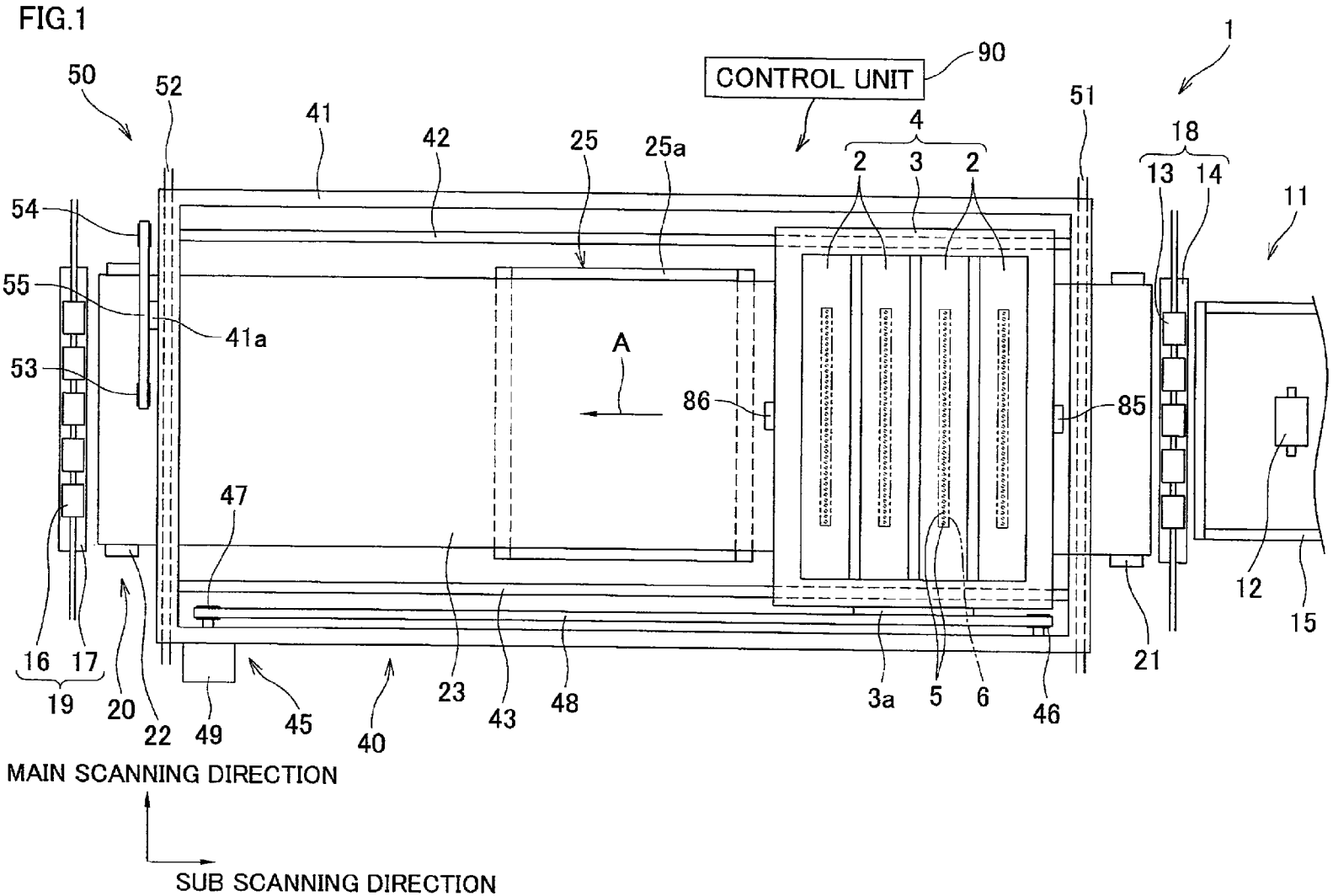
FIG. 1 is a schematic plan view of an inkjet printer according to an embodiment of the present invention.

An inkjet printer as an inkjet recording apparatus shown in FIG. 1 is a color inkjet printer having four inkjet heads 2. The inkjet printer 1 includes a sheet feed mechanism 11 and a not-illustrated sheet discharger positioned in right and left of FIG. 1, respectively. Between the sheet feed mechanism 11 and the sheet discharger is a conveyance unit 20 serving as a conveyance mechanism. The conveyance unit 20 conveys a sheet P which is a recording medium sent out from the sheet feed mechanism 11, in a conveyance direction A (sub scanning direction) which is a direction from the right to the left of FIG. 1. The printer 1 further includes: a first movement mechanism 40 which causes the inkjet heads 2 to make a first movement parallel to the conveyance direction A; a second movement mechanism 50 which causes the inkjet heads 2 to make a second movement in a direction (main scanning direction) perpendicular to the conveyance direction A; and a control unit 90 which controls operations of the four inkjet heads 2, the conveyance unit 20, the first movement mechanism 40, the second movement mechanism 50, or the like.

Note that the sub scanning direction is parallel to the conveyance direction A. The main scanning direction is perpendicular to the sub scanning direction, and is a direction along a horizontal plane (up/down direction in FIG. 1).

Figure 2:
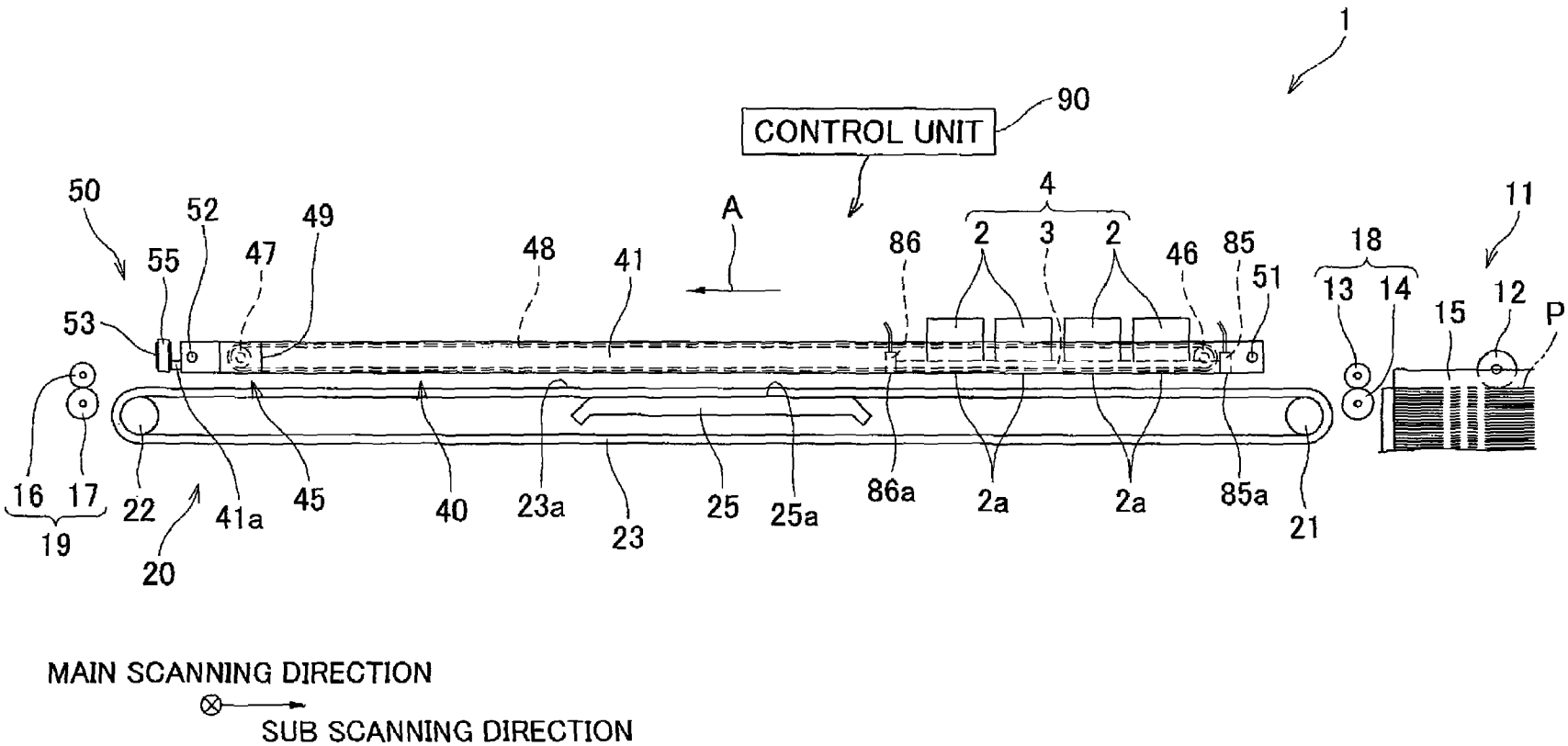
FIG. 2 is a schematic side view of an inkjet printer according to an embodiment of the present invention.

As illustrated in FIG. 2, the sheet feed mechanism 11 includes a box-shaped sheet feeder 15 which is capable of storing therein a plurality of sheets P stack in a up/down direction, and which opens in an upward direction. The sheet feed mechanism 11 further includes: a pickup roller 12 positioned so as to contact with the uppermost one of the sheets P stored in the sheet feeder 15; and a sheet feed roller group 18 including a row of rollers 13 sharing the same axis, and a long roller 14 paired with the row. The sheet feed roller group 18 is positioned between the sheet feeder 15 and the conveyance unit 20. The sheet feed roller group 18 sandwiches the sheet P sent out in the conveyance direction A by the pickup roller 12, and conveys the sheet P in the same conveyance direction A. Further, the pickup roller 12 and the sheet feed roller group 18 are rotated by a not-shown drive motor controlled by the control unit 90.

In the above structure, the pickup roller 12 and the sheet feed roller group 18 are rotated under control of the control unit 90 to send out the sheet P to the conveyance unit 20.

The four inkjet heads 2 are for ejecting four different colors of ink (magenta, yellow, cyan, and black), respectively. Each of the inkjet heads 2 has a rectangular shape long in the main scanning direction, in a plan view as illustrated in FIG. 1. Further, the four inkjet heads 2 are aligned in the sub scanning direction and fixed to a frame 3 to form a single head unit 4.

Formed on a surface of each of the inkjet heads 2 facing the conveyance unit 20 (i.e., ejection surface 2*a*) is an ink ejection area 6 formed with an ejection opening column having a plurality of ink ejection openings 5 aligned along the main scanning direction, as illustrated in FIG. 1. As illustrated in FIG. 1, the plurality of ejection openings 5 forming the ejection opening column of each of the inkjet heads 2, are arranged along the main scanning direction, equally spaced from one another at an interval corresponding to a predetermined resolution. Note that the ejection surfaces 2*a* and a lower surface of the frame 3 are formed at the same height level. Further, a not-illustrated actuator provided inside each of the inkjet heads 2 is driven under control of the control unit 90, causing ink to be ejected from the ejection openings 5.

At the centers of both ends of the frame 3 in the sub scanning direction, two photosensors 85 and 86 connected to the control unit 90 are fixed respectively. On each surface of the photosensors 85 and 86 facing the conveyance unit 20, i.e., each of detection faces 85*a* and 86*a*, a light emitting section and a light receiving section are provided. Thereby, it is possible to detect the leading and trailing ends of the sheet P in the conveyance direction A when the head unit 4 moves in a direction parallel to the conveyance direction A. Further, it is possible to detect the leading end of the conveyed sheet P when the head unit 4 is at a later-described center position. As a result, it is possible to know a timing of the sheet P and the ejection surfaces 2 facing one another. Thus, an image can be printed at an intended position on the sheet P.

As illustrated in FIG. 1, the first movement mechanism 40 includes a frame 41, two guide rails 42 and 43 extending along the sub scanning direction which are fixed in the frame 41, and a drive mechanism 45 provided nearby one end of the frame 41 in the main scanning direction (lower end in FIG. 1). In FIG. 1, the guide rail 42 is provided nearby an upper end of the frame 41. Meanwhile, the guide rail 43 is provided nearby a lower end of the frame 41. The guide rails 42 and 43 penetrate the upper and lower ends of the frame 3, respectively. The guide rails 42 and 43 support the head unit 4 so as to enable the head unit 4 to move parallel to the conveyance direction A.

As illustrated in FIG. 1, the drive mechanism 45 includes a pair of rollers 46 and 47, a belt 48 looped around the rollers 46 and 47, and a drive motor 49 fixed on one end of the frame 41 in the main scanning direction. A drive shaft of the drive motor 49 penetrates, in the main scanning direction, the one end of the frame 41. To this drive shaft is fixed the roller 47. The drive motor 49 is driven by the control unit 90 to rotate the roller 47. The roller 46 is a driven roller rotatably supported by the one end of the frame 41. Fixed on the belt 48 is a protrusion 3*a* protruded from the frame 3.

According to the above structure, the drive motor 49 is driven under control of the control unit 90 to rotate the roller 47, thereby running the belt 48. Thus, the head unit 4 makes the first movement parallel to the conveyance direction A. The first movement of the present embodiment has two movements. In one of the movements, the roller 47 rotates in a predetermined direction (counterclockwise in FIG. 2) to cause the head unit 4 to move from an upstream position (position illustrated in FIG. 1) to a downstream position of the conveyance direction A, passing through a center position (predetermined position) where the head unit 4 faces a center of the conveyance unit 20. The center position of the conveyance direction A interposes between the upstream and downstream positions. In the other movement, the roller 47 rotates in a direction opposite to the predetermined direction (clockwise in FIG. 2) to cause the head unit 4 to move in the opposite direction to the conveyance direction A; that is, from the downstream position to the upstream position, passing through the center position.

As illustrated in FIG. 1, the second movement mechanism 50 includes: two guide rails 51 and 52 penetrating, in the main scanning direction, both ends of the frame 41 in the sub scanning direction, respectively; a pair of rollers 53 and 54, positioned apart from each other in the main scanning direction; and a belt 55 looped around the rollers 53 and 54. The roller 54 is rotated by a not-illustrated drive motor controlled by the control unit 90. The roller 53 is a driven roller, and is rotatably supported. Fixed at a substantial center of the belt 55 is a protrusion 41*a* protruded from the frame 41. According to the above structure, the roller 54 rotates under control of the control unit 90 to run the belt 55, causing the frame 41 to move along the guide rails 51 and 52. Thus, the head unit 4 makes the second movement parallel to the main scanning direction.

As illustrated in FIGS. 1 and 2, the conveyance unit 20 includes a pair of rollers 21 and 22, and a conveyor belt 23 looped around the rollers 21 and 22. The roller 22 is rotated counterclockwise in FIG. 2 by a not-illustrated drive motor controlled by the control unit 90. The roller 21 is a driven roller, and is rotatably supported. A surface of the conveyor belt 23 facing the inkjet heads 2 is a conveyor surface 23*a* which conveys the sheet P. When the roller 22 rotates, the conveyor belt 23 runs so as to move the conveyor surface 23*a* in the conveyance direction A. Further, the conveyor surface 23*a* extends long in the conveyance direction A so as to face the ejection surfaces 2*a* of the inkjet heads 2, regardless of whether the inkjet heads 2 are positioned at the upstream, center, or downstream position along the conveyance direction A. As a result, no conveyance mechanism is necessary aside from the conveyance unit 20 in an area facing the inkjet heads 2. Thus, the structure of the conveyance unit is simplified.

According to the above structure, the sheet P having been conveyed to the conveyor surface 23*a* by the sheet feed roller group 18, is conveyed in the conveyance direction A by the conveyor belt 23 running under control of the control unit 90.

Further, between the pair of rollers 21 and 22 is a flat platen 25 having an upper surface 25*a* parallel to the ejection surfaces 2*a*, as illustrated in FIG. 2. The flat platen 25 is positioned where its upper surface 25*a* faces all of the four ejection surfaces 2*a* when the head unit 4 is positioned at the center position. In other words, the flat platen 25 is positioned between the pair of rollers 21 and 22. Further, the upper surface 25*a* of the flat platen 25 has a flat rectangular shape, which is slightly longer than the width of the conveyor belt 23 in the main scanning direction, and slightly longer than the total widths of the four ejection surfaces 2*a* in the sub scanning direction, as illustrated in FIG. 1. Further, as illustrated in FIG. 2, the upper surface 25*a* is in contact with a surface of the conveyor belt 23 opposite of the conveyor surface 23*a*. The upper surface 25*a* supports a middle portion of the conveyor surface 23*a* in the conveyance direction A. Thus, the flatness at the middle portion of the conveyor surface 23*a* is certainly maintained, the middle portion facing the inkjet heads 2 at the middle portion. Accordingly, it is possible to maintain the drop landing accuracy of ink on the sheet P positioned to overlap the flat platen 25. With the flat platen 25, an entire portion of the upper part of the conveyor belt 23 in FIG. 2 is hardly deflected. As a result, the flatness of the entire conveyor surface 23*a* is maintained. Thus, as in the above, it is possible to maintain the drop landing accuracy of ejected ink on the sheet P positioned not to overlap the flat platen 25.

Further, the printer 1 includes a sheet discharge roller group 19 provided downstream of the conveyance unit 20 in the conveyance direction A. The sheet discharge roller group 19 has substantially the same structure as the sheet feed roller group 18. The sheet discharge roller group 19 includes a row of rollers 16 sharing the same axis, and a long roller 17 paired with the row. The sheet discharge roller group 19 sandwiches the sheet P conveyed by the conveyance unit 20, and conveys the sheet P in the conveyance direction A. Further, the sheet discharge roller group 19 is rotated by a not-illustrated drive motor controlled by the control unit 90. According to the above structure, the sheet discharge roller group 19 rotate to eject the sheet P to the sheet discharger, under control of the control unit 90.

Figure 3:
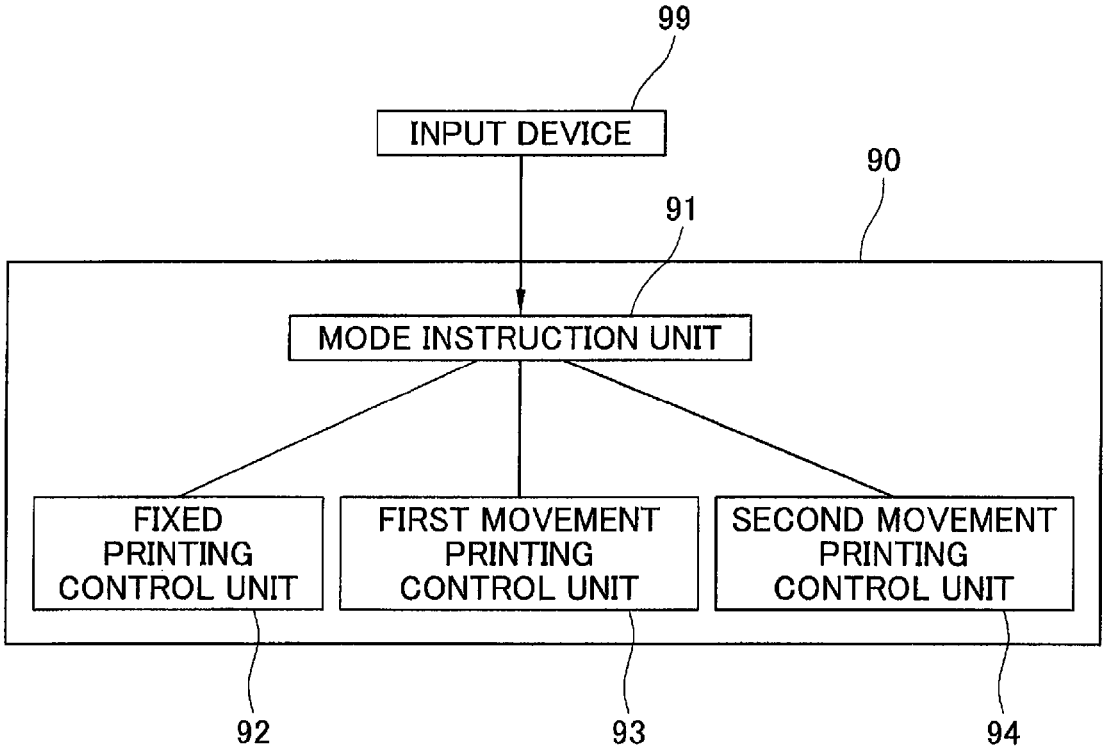
FIG. 3 is a block diagram illustrating a schematic configuration of a control unit illustrated in FIG. 1.

The following describes the control unit 90 with reference to FIG. 3. The control unit 90 includes: a CPU (Central Processing Unit); an input/output interface; a ROM (Read Only Memory) which stores therein various kinds of programs, data, or the like for controlling a total operation of the inkjet printer 1; and the like. Each of the later-described units 91 to 94 (cf. FIG. 3) is realized by combining the hardware and software.

As illustrated in FIG. 3, the control unit 90 includes a mode instruction unit 91, a fixed printing control unit 92, a first movement printing control unit 93, and a second movement printing control unit 94.

The mode instruction unit 91 receives and stores therein information which is input with image data through an operation of an input device 99 of a PC (Personal Computer) or the like by an operator. An example of the information input into the mode instruction unit 91 is: a signal to select one of the following modes: the fixed printing mode for high speed printing, the first movement printing mode for high quality printing, and the second movement printing mode for high density printing. The mode instruction unit 91 thereby instructs, in a switchable manner, which one of the fixed printing control unit 92, the first printing control unit 93, and the second printing control unit 94 is to be active. In other words, when a signal to select the fixed printing mode is input, the mode instruction unit 91 instructs to activate the fixed printing control unit 92. When a signal to select the first movement printing mode is input, the mode instruction unit 91 instructs to activate the first movement printing control unit 93. When a signal to select the second movement printing mode is input, the mode instruction unit 91 instructs to activate the second movement printing control unit 94.

In the present embodiment, by storing information input through an operation by the operator, the mode instruction unit 91 instructs, in a switchable manner, which one of the fixed printing control unit 92, the first movement printing control unit 93, and the second movement printing control unit 94 is to be active. For instance, the printer may include a sensor to distinguish a type of the sheet P (e.g., plain paper, glossy paper, or the like) stored in the sheet feeder 15, thereby enabling the mode instruction unit 91 to instruct, based on a signal transmitted from the sensor to the control unit 90, which one of the fixed printing control unit 92, the first movement printing control unit 93, and the second movement printing control unit 94 is to be active. Specifically, when the sheet P stored in the sheet feeder 15 is glossy paper, the mode instruction unit 91 instructs to activate the first movement printing control unit 93, so as to enter the first movement printing mode only with information on image data inputted through the input device based on an operator's operation. Meanwhile, when the sheet P stored in the sheet feeder 15 is plane paper, the mode instruction unit 91 instructs to activate the fixed printing control unit 92, so as to enter the fixed printing mode only with information on image data inputted through the input device based on an operator's operation. Note that in this modified example, a mode instructor is realized with the mode instruction unit 91 and the sensor.

The fixed printing control unit 92 controls: the first movement mechanism 40 to stop the head unit 4 at the center position; the conveyance unit 20 so that the sheet P passes through such an area that the sheet P faces the ejection surfaces 2*a*, the sheet P being sent out from the sheet feeder 15 to the conveyance unit 20; and the four inkjet heads 2 to eject ink to the moving sheet P.

The first movement printing control unit 93 controls: the conveyance unit 20 so that the sheet P sent out from the sheet feeder 15 to the conveyance unit 20 stops at such a position where the sheet P overlaps the flat platen 25; and the first movement mechanism 40 and the four inkjet heads 2 so that each of the inkjet heads 2, while making the first movement, ejects ink to the stopped sheet P. After a printing operation on one sheet P, the first movement printing control unit 93 controls the first movement mechanism 40 and the four inkjet heads 2 during a subsequent printing operation on another sheet P so that each of the inkjet heads 2 ejects ink on the stopped sheet P while making the first movement in the opposite direction to the first movement made in the previous printing operation.

The second movement printing control unit 94 controls: the conveyance unit 20 so that the sheet P sent out from the sheet feeder 15 to the conveyance unit 20 stops at a position where the sheet P overlaps the flat platen 25; the first movement mechanism 40 and the four inkjet heads 2 so that each of the inkjet heads 2, while making one first movement (former first movement) in one direction and the other first movement (latter first movement) in the opposite direction, ejects ink to the stopped sheet P; the second movement mechanism 50 so that after the former first movement, the inkjet heads 2 make the second movement for one-half of a distance corresponding to a predetermined resolution.

The following describes a printing operation carried out when an image is printed on the sheet P, with reference to FIGS. 4A to 6B.

When information on a signal to select the fixed printing mode, image data, or the like is inputted into the control unit 90 through the operation of the input device 99 by an operator, the fixed printing control unit 92 is activated on an instruction by the mode instruction unit 91.

Figure 4A:
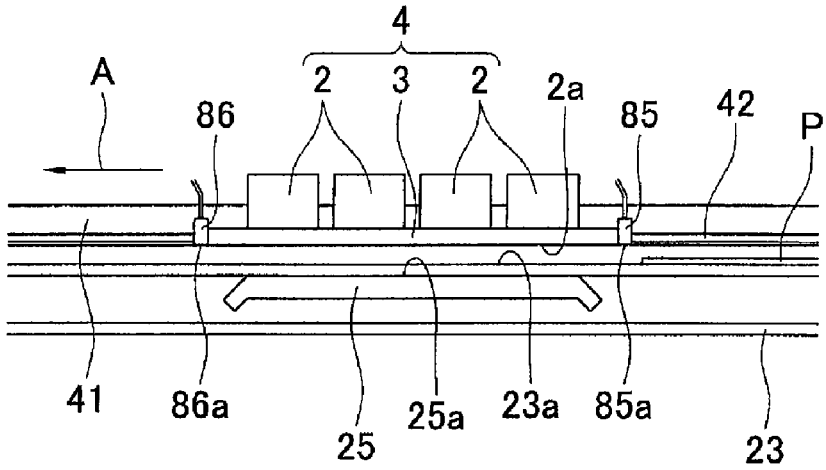
FIGS. 4A and 4B are side views illustrating a printing operation performed on a sheet in fixed printing mode.
Figure 4B:
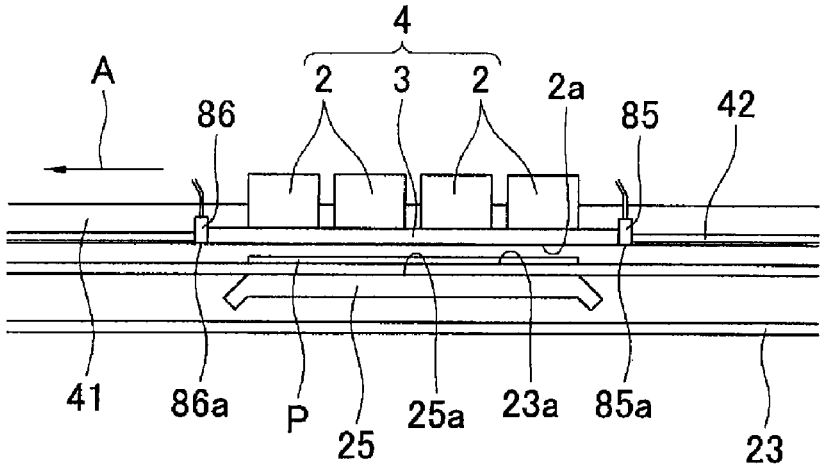

Specifically, the sheet P is first sent out from the sheet feeder 15 to the conveyance unit 20 by the pickup roller 12 and the sheet feed roller group 18, under control of the control unit 90. At this operation, the fixed printing control unit 92 performs control to rotate the roller 47 so as to move the head unit 4 located at the upstream or downstream position in a direction towards the center position, and to stop the head unit 4 when the head unit 4 arrives at the center position as illustrated in FIG. 4(A). Note that the first movement mechanism 40 does not move the head unit 4 when the head unit 4 is already at the center position.

Then, the conveyor belt 23 is run under control of the fixed printing control unit 92 to convey the sheet P in the conveyance direction A so that the sheet P passes through an area where the sheet P faces the ejection surfaces 2*a*. At this operation, the photosensor 85 detects a leading end of the sheet P in the conveyance direction A. Upon the detection by the photosensor 85, the fixed printing control unit 92 controls the inkjet heads 2. Through this control, ink is ejected sequentially from the ejection openings 5 of the most upstream inkjet head 2 in the conveyance direction A, at an appropriate timing when the sheet P passes through an area where the sheet P faces the ink ejection area 6. As a result, an image is printed at a desired position on the moving sheet P.

The sheet P with an image printed thereon is conveyed by the running conveyor belt 23 towards the sheet discharge roller group 19. The sheet P is then ejected to the sheet discharger by the sheet discharge roller group 19. Thus, a printing operation on a single sheet P ends.

Further, when information on a signal to select the first movement printing mode, image data, and the like are inputted into the control unit 90 through the operation of the input device 99 by an operator, the first movement printing control unit 93 is activated on an instruction by the mode instruction unit 91.

Specifically, the sheet P is first sent out from the sheet feeder 15 to the conveyance unit 20 by the pickup roller 12 and the sheet feed roller group 18, under control of the control unit 90. At this operation, the conveyor belt 23 is run under control of the first movement printing control unit 93 so as to stop the sheet P conveyed to the conveyor surface 23*a* of the conveyor belt 23, at a position where the entire sheet P overlaps the flat platen 25, as illustrated in FIG. 5A.

Figure 5A:
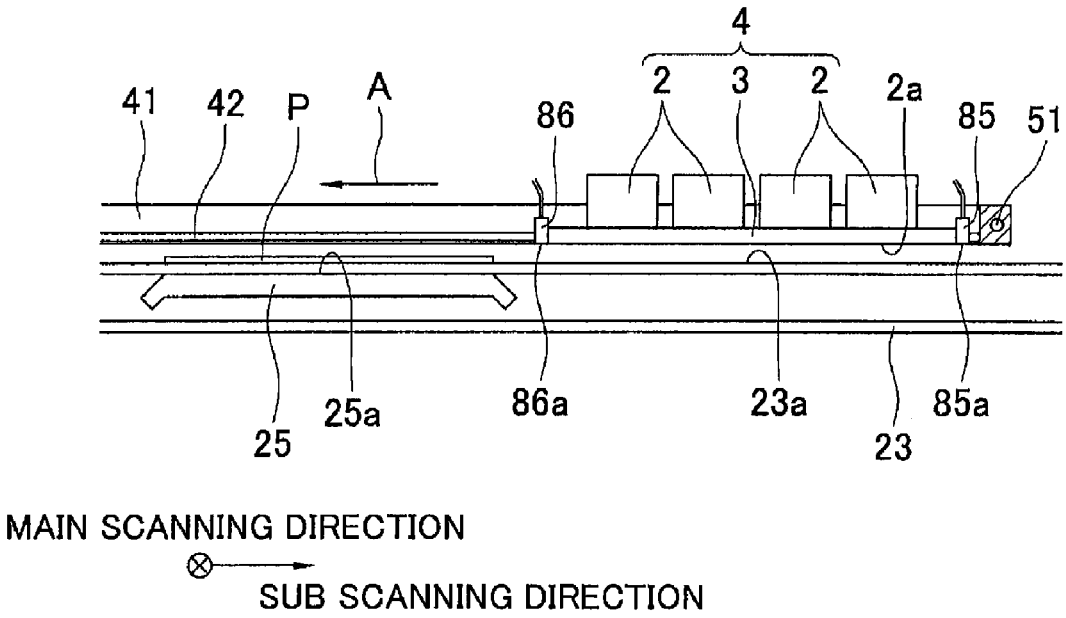
FIGS. 5A and 5B are side views illustrating a printing operation performed on a sheet in the first movement printing mode.
Figure 5B:
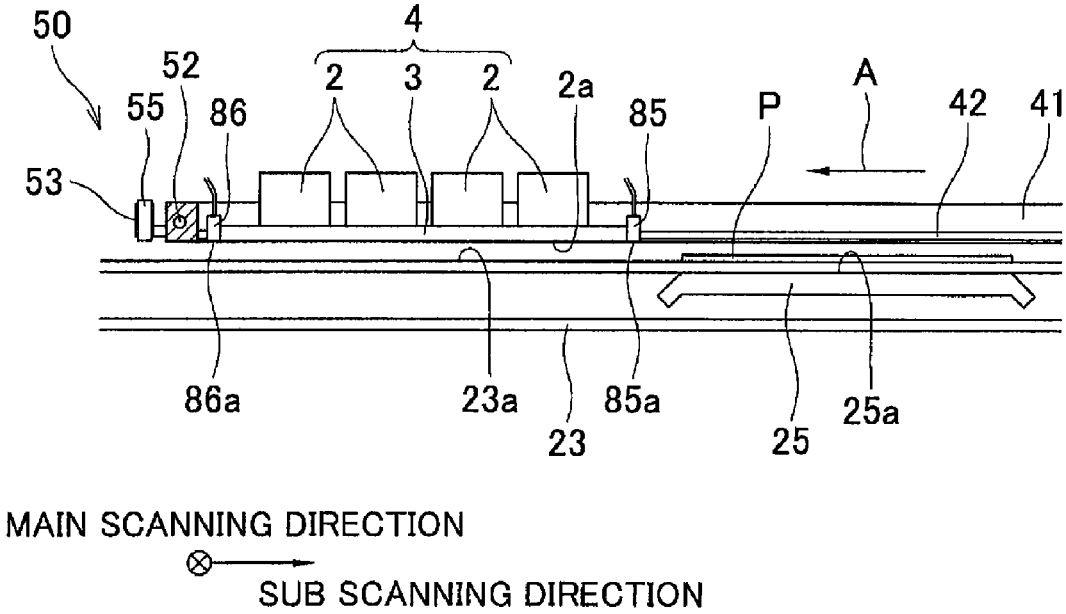

Then, under control of the first movement printing control unit 93, the roller 47 rotates in a predetermined direction so that the head unit 4 makes the first movement parallel to the conveyance direction A, so as to move from the upstream position as indicated in FIG. 5A to the downstream position as indicated in FIG. 5B. At this operation, the photosensor 86 detects a trailing end of the sheet P in the conveyance direction A. Upon the detection by the photosensor 86, the first movement printing control unit 93 controls the inkjet heads 2. Through this control, ink is ejected sequentially from the ejection openings 5 of the most downstream inkjet head 2 of the movement direction of the head unit 4, at an appropriate timing when the sheet P passes through an area where the sheet P faces the ink ejection area 6. As a result, an image is printed at a desired position on the stopped sheet P.

Next, under control of the first movement printing control unit 93, the conveyor belt 23 runs to convey the sheet P with an image printed thereon, towards the sheet discharge roller group 19, so that the sheet P is ejected to the sheet discharger by the sheet discharge roller group 19. Thus, a printing operation on a single sheet P ends.

Note that continuous printing on a plurality of sheets P is performed as follows in the first movement printing mode. A printing operation is performed on a sheet P as described above. Then, another sheet P is sent out from the sheet feeder 15 to the conveyance unit 20 so that under control of the first movement printing control unit 93, the sheet P sent onto the conveyor surface 23*a* of the conveyor belt 23 stops at a position where the entire sheet P overlaps the flat platen 25. Nest, under control of the first movement printing control unit 93, the roller 47 rotates in an opposite direction to the predetermined direction, enabling the head unit 4 to make a first movement in an opposite direction to the first movement made in the previous printing operation; that is, to make a movement from the downstream position to the upstream position. At this operation, the photosensor 85 detects a leading end of the sheet P in the conveyance direction A. Upon the detection by the photosensor 85, the first movement printing control unit 93 controls the inkjet heads 2. Through this control, ink is ejected sequentially from the ejection openings 5 of the most downstream inkjet head 2 of a movement direction of the head unit 4, at an appropriate timing when the sheet P passes through an area where the sheet P faces the ink ejection area 6. As a result, an image is printed at a desired position on the stopped sheet P. Then, the sheet P with an image printed thereon is ejected to the sheet discharger, like the previous printing operation. Thus, a printing operation on a second sheet P ends.

Thus, when performing continuous printing on a plurality of sheets P, during or after each printing operation but before a subsequent printing operation, it is not necessary to bring the inkjet heads 2 back to a state in which they were prior to a previous first movement. Accordingly, a printing operation on the following sheets P starts sooner. This shortens a total operation time of a continuous printing operation.

Further, when information on a signal to select the second movement printing mode, image data, and the like are input into the control unit 90 through the operation of the input device 99 by an operator, the second movement printing control unit 94 is activated on an instruction by the mode instruction unit 91.

Specifically, the sheet P is first sent out from the sheet feeder 15 to the conveyance unit 20 by the pickup roller 12 and the sheet feed roller group 18, under control of the control unit 90. At this operation, the conveyor belt 23 is run under control of the second movement printing control unit 94 run so as to stop the sheet P sent onto the conveyor surface 23*a* of the conveyor belt 23, at a position where the entire sheet P overlaps the flat platen 25.

Figure 6A:
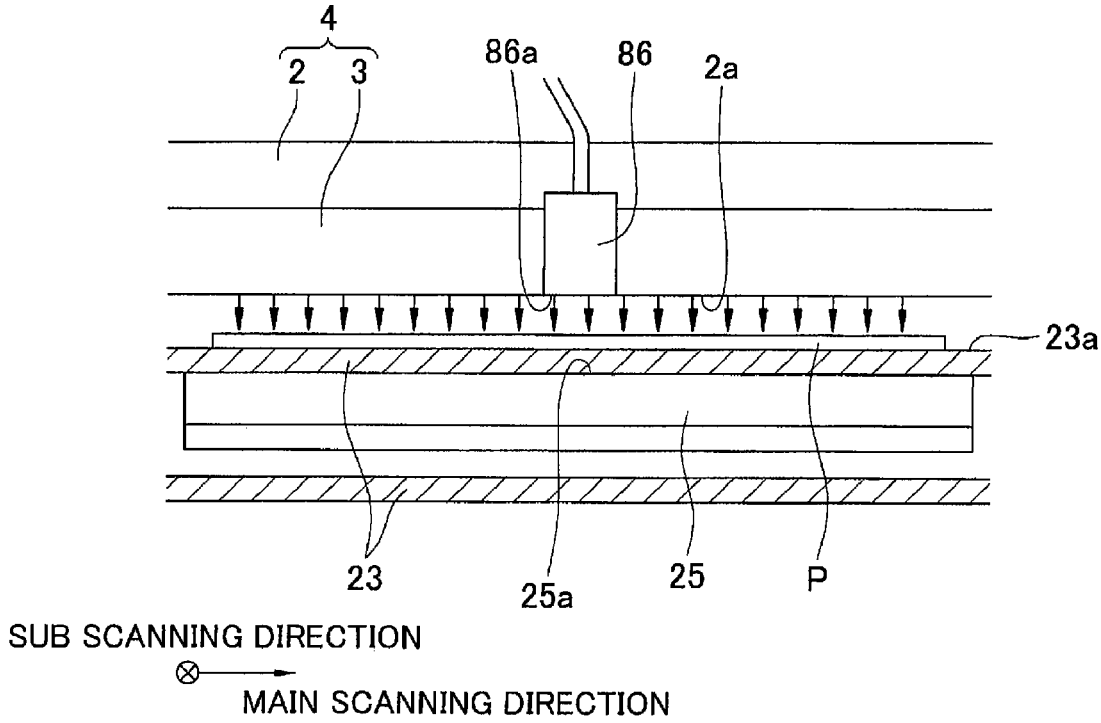
FIG. 6A is a side view illustrating an ejection position of ink ejected from the inkjet heads in a second movement printing mode, and an ejection position of ink ejected in a former first movement.

Next, under control of the second movement printing control unit 94, the roller 47 rotates in a predetermined direction, enabling the head unit 4 to make the first movement parallel to the conveyor direction A; that is, to make a movement from the upstream position to the down stream position. At this operation, the photosensor 86 detects a trailing end of the sheet P in the conveyance direction A. Upon the detection by the photosensor 86, the second movement printing control unit 94 controls the inkjet heads 2. Through this control, ink is ejected to the stopped sheet P, sequentially from the ejection openings 5 of the most downstream inkjet head 2 of a movement direction of the head unit 4, at an appropriate timing when the sheet P passes through an area where the sheet P faces the ink ejection area 6, as illustrated in FIG. 6A. Note that the black arrows illustrated in FIG. 6A indicate ejection positions of ink ejected when the former first movement is made during a printing operation on one sheet P.

Figure 6B:
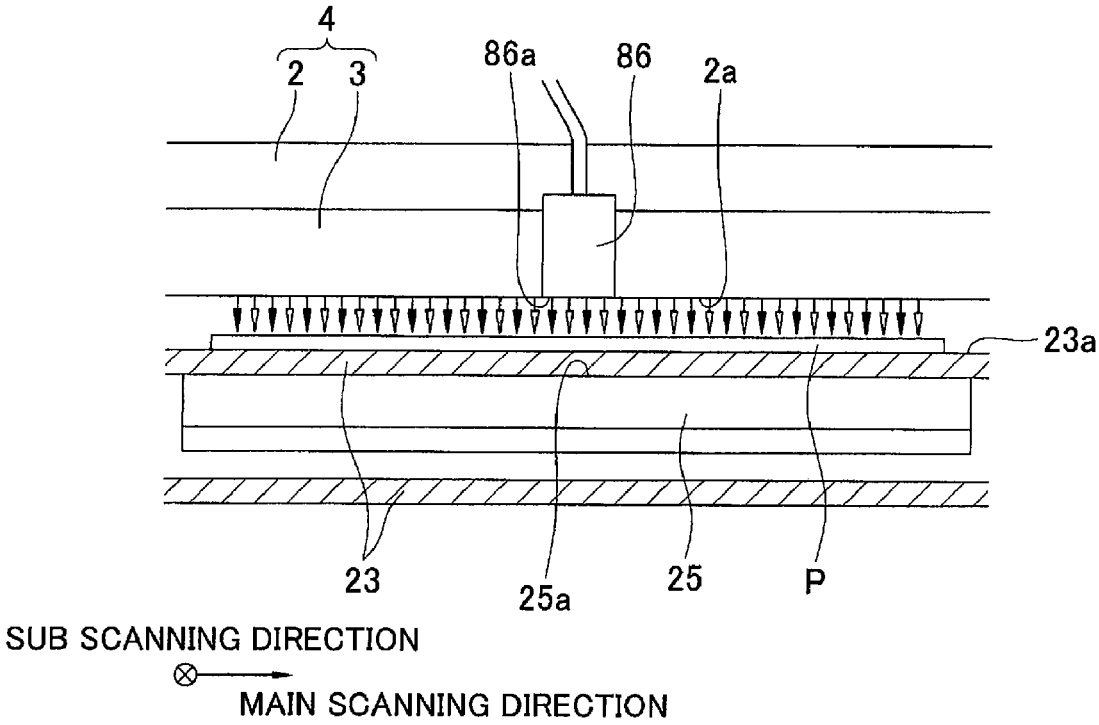
FIG. 6B is a side view illustrating an ejection position of ink ejected from the inkjet heads in the second movement printing mode, and an ejection position of ink ejected in a latter first movement.

Next, under control of the second movement printing control unit 94, the roller 54 slightly rotates so as to move the inkjet heads 2, in the main scanning direction, for one-half of an interval between ejection openings (predetermined resolution). Thus, the head unit 4 and the frame 41 both make the second movement. The second movement enables, during a printing operation on one sheet P, a next ink ejection position (white arrow) to be positioned in the middle of adjacent eject positions indicated with black arrows from which ink is previously ejected, as illustrated in FIG. 6B.

Then, under control of the second movement printing control unit 94, the roller 47 rotates in an opposite direction to the predetermined direction, enabling the head unit 4 to make the first movement in an opposite direction to the conveyance direction A; that is, to make a movement from the downstream position to the upstream position. At this operation, the photosensor 85 detects a leading end of the sheet P in the conveyance direction A. Upon the detection by the photosensor 85, the second movement printing control unit 94 controls the inkjet heads 2. Through this control, ink is ejected to the stopped sheet P, sequentially from the ejection openings 5 of the most downstream inkjet head 2 of a movement direction of the head unit 4 at an appropriate timing when the sheet P passes through an area where the sheet P faces the ink ejection area 6, as illustrated in FIG. 6B. As a result, it is possible to print, at a predetermined position on the sheet P, a high density image with double the resolution corresponding to an interval between ejection openings.

By running the conveyor belt 23, the sheet P with an image printed thereon is conveyed towards the sheet discharge roller group 19, and is ejected to the sheet discharger by the sheet discharge roller group 19. Thus, a printing operation on a single sheet P ends.

As described above, with the inkjet printer 1 of the present embodiment, an operator who wishes high quality printing is able to select the first movement printing mode in which printing is performed by ejecting ink on the stopped sheet P while moving the inkjet heads 2. On the other hand, an operator who wishes high speed printing is able to select the fixed printing mode in which printing is performed by ejecting ink on the moving sheet P from the stopped inkjet heads 2. Thus, the inkjet printer 1 is capable of adapting to both high quality printing and high speed printing.

In addition to the first movement printing mode and the fixed printing mode, the operator is able to select the second movement printing mode which enables high density printing on the sheet P, with a resolution corresponding to one half of an interval between ejection openings.

The above embodiment deals with a case where, in the printing operation controlled by the fixed printing control unit 92, the head unit 4 is positioned at the center position and then an image is printed onto the moving sheet P. However, an image may be printed onto the sheet P while the head unit 4 positioned at either one of the upstream and downstream positions. In a continuous printing operation performed under control of the first movement printing control unit 93, a first movement is made in an opposite direction to the first movement made in the previous printing operation. However, first movements in the same direction may be made while printing an image on the sheet P in any printing operation. Further, the second movement mechanism, the second movement printing control unit 94, and the flat platen 25 may be omitted.

The above embodiment deals with a case where the four inkjet heads 2 are supported indirectly by the guide rails 42 and 43 penetrating the upper and lower ends of the frame 3, respectively. However, the inkjet heads 2 may be supported directly by the guide rails 42 and 43. In such case, it is necessary that the guide rails 42 and 43 support the inkjet heads 2 so as to enable the inkjet heads 2 to move parallel to the conveyance direction A, as in the above embodiment. Alternatively, the four inkjet heads 2 may be supported by the frame 41 so as to enable the inkjet heads 2 to move parallel to the conveyance direction A. The four inkjet heads 2 may be fixed to the frame 41. In such case, it is necessary to employ, as the first movement mechanism 40, a structure enabling the whole frame 41 to move parallel to the conveyance direction A.

Further, the above embodiment deals with a case where the four inkjet heads 2 are fixed indirectly to the belt 48 which the frame 3 supporting the inkjet heads 2 is fixed to. However, the inkjet heads 2 may be fixed directly to the belt 48.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus comprising:

a conveyance mechanism which conveys a recording medium in a conveyance direction;

an inkjet head having an ejection surface on which a plurality of ink ejection openings are formed, the ink ejection openings being arranged so that the inkjet head has a predetermined resolution in a direction perpendicular to the conveyance direction;

a first movement mechanism which causes the inkjet head to make a first movement between an upstream position and a downstream position, the first movement being a movement in the conveyance direction, the upstream position and the downstream position sandwiching therebetween a predetermined position along the conveyance direction;

a first movement printing controller which controls: the conveyance mechanism so that a recording medium stops at such a position that the recording medium faces the ejection surface of the inkjet head positioned at the predetermined position; and then the inkjet head and the first movement mechanism so that the inkjet head, while making the first movement, ejects ink to the stopped recording medium;

a second movement mechanism which causes the inkjet head to make a second movement which is a movement in the direction perpendicular to the conveyance direction;

a second movement printing controller which controls:

the conveyance mechanism so that a recording medium stops at the position where the recording medium faces the ejection surface of the inkjet head positioned at the predetermined position; the inkjet head and the first movement mechanism so that the inkjet head, while making the first movement in one direction, ejects ink to the stopped recording medium;

the second movement mechanism so that the inkjet head makes the second movement for one-half of a distance corresponding to the predetermined resolution;

and then the inkjet head and the first movement mechanism so that the inkjet head, while making the first movement in the opposite direction to that one direction, ejects ink to the stopped recording medium, and a mode instructor which instructs, in a switchable manner, which one of the first movement printing controller and the second movement printing controller is to be active.

2. The inkjet recording apparatus according to claim 1, wherein the inkjet recording apparatus further comprises:

fixed printing controller which controls: the conveyance mechanism so that a recording medium passes through such an area that the recording medium faces the ejection surface; and then the inkjet head so that the inkjet head, while being stationary, ejects ink to the moving recording medium;

and wherein the mode instructor instructs, in a switchable manner, which one of the first movement printing controller, the second movement printing controller, and the fixed printing controller is to be active.

3. The inkjet recording apparatus according to claim 2, wherein a sensor capable of detecting an end of a recording medium is provided at each of two positions sandwiching therebetween the inkjet head in the conveyance direction, wherein the fixed printing controller controls the inkjet head so that the inkjet head, while being stationary, ejects ink to the moving recording medium upon detection of an end of the moving recording medium by a most upstream one of the sensors in the conveyance direction, and wherein the first movement printing controller controls the inkjet head and the first movement mechanism so that the inkjet head, while making the first movement, ejects ink to the stopped recording medium upon detection of an end of the stopped recording medium by a most downstream one of the sensors in the first movement.

4. The inkjet recording apparatus according to claim 1, wherein, after one printing operation on a recording medium, the first movement printing controller controls the first movement mechanism during a subsequent printing operation on another recording medium so that the inkjet head makes the first movement in an opposite direction to the first movement made in that one printing operation.

5. The inkjet recording apparatus according to claim 1, wherein the conveyance mechanism has a pair of rollers and a conveyor belt looped around the rollers, and wherein a conveyor surface of the conveyor belt extends to (i) such a position that the conveyor surface faces the ejection surface of the inkjet head positioned at the upstream position, and (ii) such a position that the conveyor surface faces the ejection surface of the inkjet head positioned at the downstream position, the conveyor surface conveying a recording medium.

6. The inkjet recording apparatus according to claim 5, wherein a platen supporting the conveyor surface is positioned so as to face the ejection surface of the inkjet head positioned at the predetermined position.

7. The inkjet recording apparatus according to claim 6, wherein an upper surface of the platen is longer than the width of the conveyance belt in the direction perpendicular to the conveyance direction, and longer than the width of the ejection surface in the conveyance direction.

8. The inkjet recording apparatus according to claim 1, wherein the first movement mechanism comprises:

two first guide rails extending along the conveyance direction and supporting the inkjet head so as to enable the inkjet head to move parallel to the conveyance direction;

a pair of rollers;

a belt which the inkjet head is fixed to and is looped around the rollers; and a drive motor for rotating the rollers.

9. The inkjet recording apparatus according to claim 1, wherein the first movement mechanism further comprises a frame which is positioned so as to surround the inkjet head and which the inkjet head is fixed to, wherein the second movement mechanism comprises:

two second guide rails positioned so as to penetrate, in the direction perpendicular to the conveyance direction, both ends of the frame in the conveyance direction;

a pair of rollers; and a belt which the frame is fixed to and is looped around the rollers, and wherein the frame moves along the second guide rails.

10. The inkjet recording apparatus according to claim 1, wherein a sensor capable of detecting an end of a recording medium is provided at each of two positions sandwiching therebetween the inkjet head in the conveyance direction, and wherein the second movement printing controller controls the inkjet head and the first movement mechanism so that, while the inkjet head makes the first movement in either one of the two directions opposite to each other, the inkjet head ejects ink to the stopped recording medium upon detection of an end of the stopped recording medium by a most downstream one of the sensors in that either one of the two directions.

* * * * *